US009495944B1

(12) United States Patent
Chen

(10) Patent No.: US 9,495,944 B1
(45) Date of Patent: Nov. 15, 2016

(54) DRUM FRAME FIXER

(71) Applicant: Kuo-Chang Chen, Taichung (TW)

(72) Inventor: Kuo-Chang Chen, Taichung (TW)

( * ) Notice: Subject to any disclaimer, the term of this patent is extended or adjusted under 35 U.S.C. 154(b) by 0 days.

(21) Appl. No.: 14/848,783

(22) Filed: Sep. 9, 2015

(51) Int. Cl.
*G10D 13/02* (2006.01)

(52) U.S. Cl.
CPC ..... *G10D 13/02* (2013.01); *G10D 13/023* (2013.01)

(58) Field of Classification Search
CPC ..... G10D 13/023
See application file for complete search history.

(56) References Cited

U.S. PATENT DOCUMENTS 4,282,793 A * 8/1981 Muchnick ..... D06M 15/55 428/131
4,750,401 A * 6/1988 Hoshino ..... F16B 7/06 84/413
7,507,890 B1 * 3/2009 Sikra ..... G10D 13/023 84/411 R
7,825,318 B2 * 11/2010 Ito ..... G10D 13/023 84/411 R
7,960,633 B1 * 6/2011 Chen ..... G10D 13/023 84/411 R
8,110,730 B2 * 2/2012 Burdick ..... G10D 13/023 84/411 R
2007/0144332 A1 * 6/2007 Chen ..... G10D 13/023 84/422.1
2012/0174733 A1 * 7/2012 Takegawa ..... B21D 53/52 84/413

FOREIGN PATENT DOCUMENTS

TW M322594 11/2007

* cited by examiner

*Primary Examiner* — Robert W Horn
(74) *Attorney, Agent, or Firm* — Muncy, Geissler, Olds & Lowe, P.C.

(57) ABSTRACT

A drum frame fixer provided for fastening at least one drum rim to a drum body includes: a main body, for being arranged on a circumferential face of the drum body, formed with at least one assembling hole, an inner wall of each assembling hole being formed with a first internal threaded portion; at least one screwed portion, each screwed portion having a first external threaded portion screwed in each first internal threaded portion and a second internal threaded portion; at least one fixing portion, each fixing portion having an abutting head and a second external threaded portion, each fixing portion provided for being disposed through the drum rim, the abutting head abutting against a side of the drum rim, the second external threaded portion being screwed to a second internal threaded portion of the screwed portion located by the other side of the drum rim.

10 Claims, 5 Drawing Sheets

DRUM FRAME FIXER

BACKGROUND OF THE INVENTION

1. Field of the Invention

The present invention relates to a fixer, and more particularly to a drum frame fixer.

2. Description of the Prior Art

A conventional drum frame fixer is formed with a threaded hole on a rod thereof, the rod is fixed on a drum body, a screw is disposed through a drum rim to be screwed to the threaded hole so as to position the drum rim on the drum body. However, through this screwing method, if a fixing hole of the drum rim and the threaded hole are not corresponding to each other, it is difficult to assemble the screw, and the threads in the threaded hole may be damaged.

Therefore, a drum frame fixer as disclosed in TWM322594 has a main body, a screwed member and a screw. Each of two opposite ends of the main body is formed with a fastening portion. A rod is disposed between the two fastening portions, each said fastening portion has an assembling hole, the screwed member has an internal threaded portion, the screwed member can be positionably disposed in the assembling hole of the fastening portion via the rod, and the screw can be disposed through the drum rim to be screwed to the internal threaded portion of the screwed member; therefore, the screwed member can shorten a length of a thread, and it is more convenient to screw the screw and assemble the drum frame fixer.

However, when assembling the drum frame fixer with this type of screw, the screwed member, fastening portion and rod need to cooperate with one another to position the screwed member between the fastening portion and the rod. Therefore, it is still inconvenient to assemble this type of drum frame fixer.

The present invention has arisen to mitigate and/or obviate the afore-described disadvantages.

SUMMARY OF THE INVENTION

The major object of the present invention is to provide a drum frame fixer which can be assembled to an assembling hole of a fastening portion via threads on an outer side of a screwed portion. Compared with prior arts, the drum frame fixer does not need to cooperate with a rod to be positioned, so it is easier to assemble the drum frame fixer. In addition, the screwed portion can be screwed to the assembling hole from an outer side of the main body; therefore, when a user wants to replace the screwed portion, s/he does not need to disassemble the main body from a drum body.

To achieve the above and other objects, a drum frame fixer is provided for fastening at least one drum rim on a drum body. The drum frame fixer includes: a main body, provided for being arranged on a circumferential face of the drum body, formed with at least one assembling hole, an inner wall of each said assembling hole formed with a first internal threaded portion; at least one screwed portion, each said screwed portion having a first external threaded portion which is screwed in each said first internal threaded portion and a second internal threaded portion; at least one fixing portion, each said fixing portion having an abutting head and a second external threaded portion, each said fixing portion provided for being disposed through the drum rim, the abutting head abutting against a side of the drum rim, the second external threaded portion being screwed to a second internal threaded portion of the screwed portion located by the other side of the drum rim.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
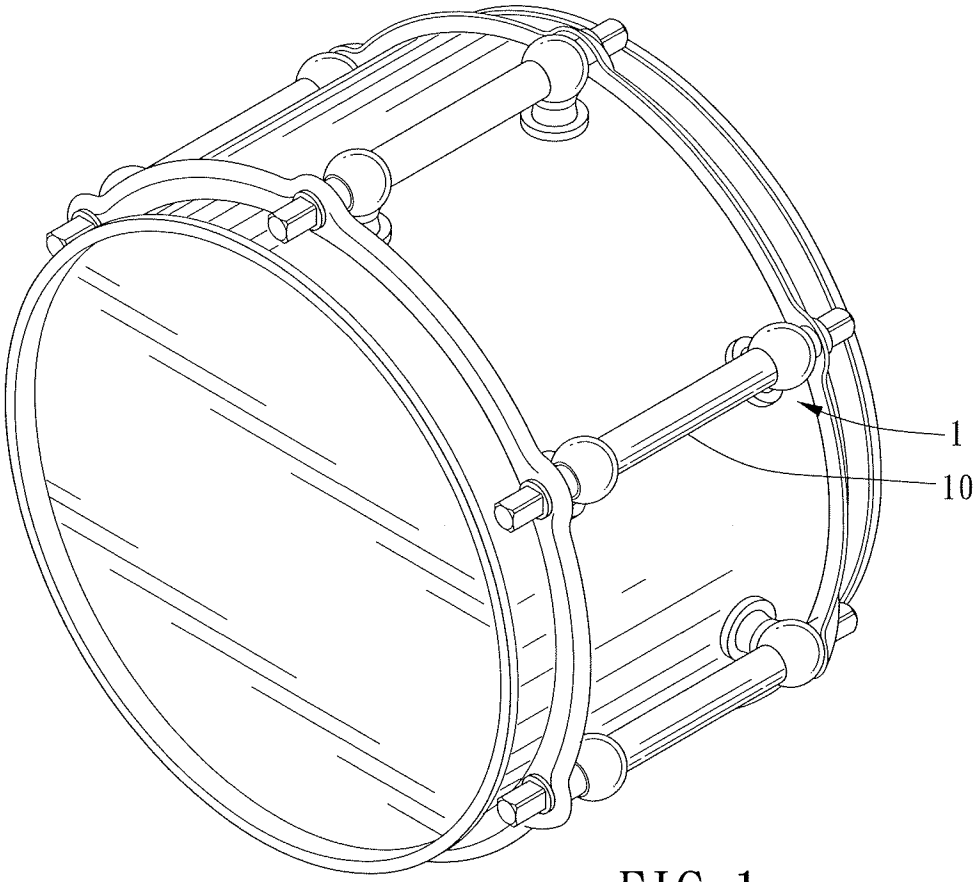
FIG. 1 is a perspective drawing of a first embodiment of the present invention.
Figure 2:
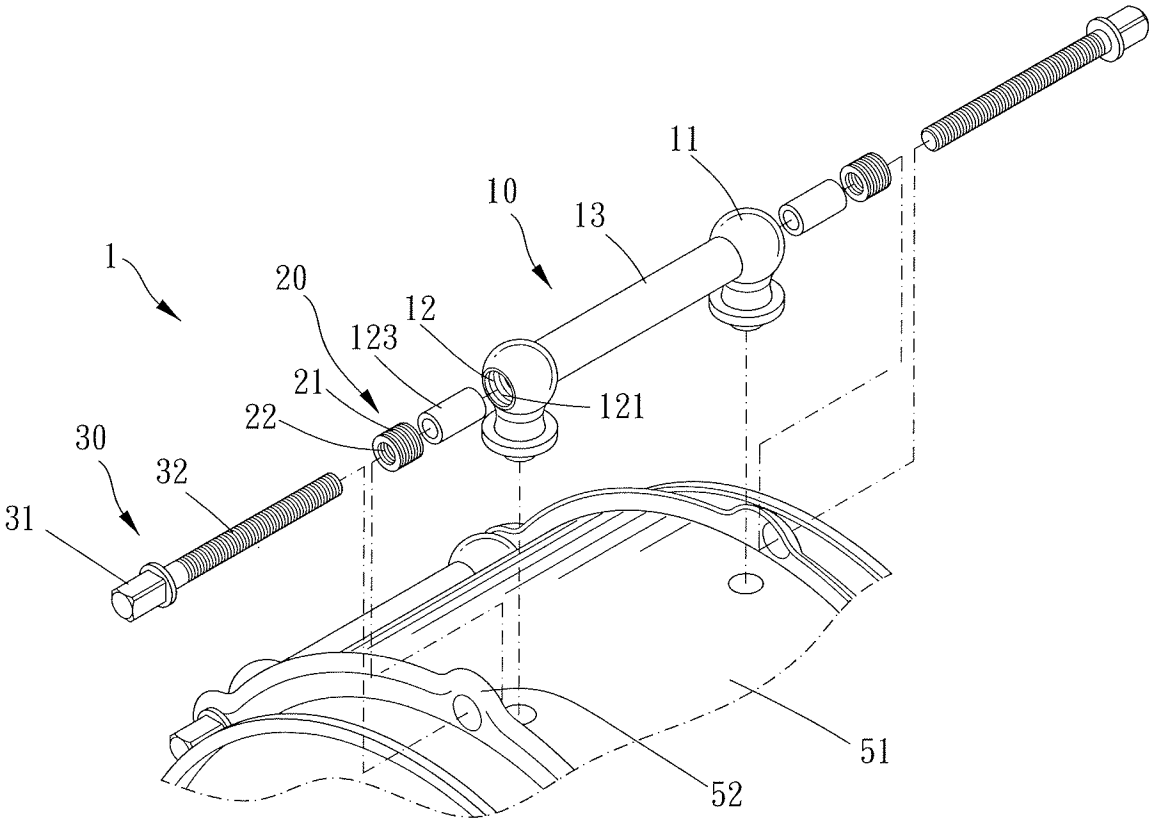
FIG. 2 is a breakdown drawing of the first embodiment of the present invention.
Figure 3:
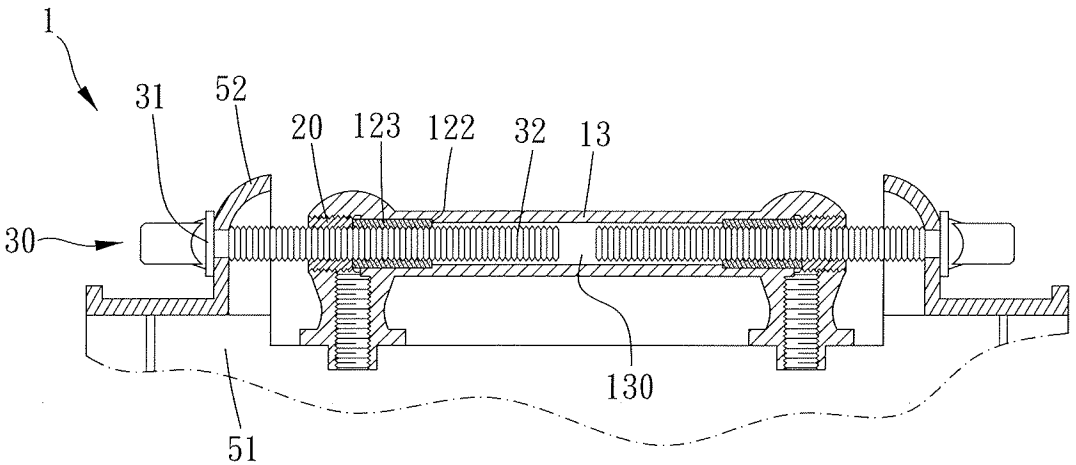
FIG. 3 is a cross-sectional drawing of the first embodiment of the present invention.

Please refer to FIGS. 1 to 3 for a first preferred embodiment of the present invention. A drum frame fixer 1 is provided for fastening at least one drum rim 52 to a drum body 51. The drum frame fixer 1 includes a main body 10, at least one screwed portion 20 and at least one fixing portion 30.

The main body 10 is provided for being arranged on a circumferential face of the drum body 51. The main body 10 is formed with at least one assembling hole 12, and an inner wall of each said assembling hole 12 is formed with a first internal threaded portion 121. In this embodiment, the drum body 51 is a drum body of a side drum (of course, the drum body may be a drum body of a bass drum or other drums)

Each said screwed portion 20 has a first external threaded portion 21 which is screwed in each said first internal threaded portion 121 and a second internal threaded portion 22. In this embodiment, each said screwed portion 20 is a one-piece member which is integrally formed, and the second internal threaded portion 22 is provided on an inner wall surface of the screwed portion 20. In addition, the screwed portion 20 is screwed from an end side of the main body 10 inwardly into the assembling hole 12. When a user wants to replace user wants to replace the screwed portion 20, s/he only needs to loosen the screwed portion 20 out of the assembling hole 12 from outside without disassembling the main body 10.

To prevent the fixing member 30 from loosening off from the main body 10 when a drum is beaten, the assembling hole 12 is further formed with an internal shoulder portion 122, and an intermediate member 123 is inserted into the assembling hole 12. The intermediate member 123 abuts against between the screwed portion 20 and the internal shoulder portion 122 axially, and the fixing portion 30 is inserted into the intermediate member 123; hence, the intermediate member 123 can reduce shaking and prevent the fixing portion 30 from loosening off from the assembling hole 12. In addition, the screwed portion 20 and the internal shoulder portion 122 abut against the intermediate member 123 axially so as to position the intermediate member 123 in the assembling hole 12.

Each said fixing portion 30 has an abutting head 31 and a second external threaded portion 32, each said fixing portion 30 is provided for being disposed through the drum rim 52, the abutting head 31 abuts against a side of the drum rim 52, and the second external threaded portion 32 is screwed to the second internal threaded portion 22 of the screwed portion 20 located by the other side of the drum rim 52; therefore, the drum rim 52 can be fastened on the drum body 51. In other embodiments, an intermediate member may be further sandwiched between the abutting head and the drum rim to provided preferable shock-absorbing and anti-loosening effect. It is to be noted that the screwed portion may be replaced with screwed portions having second internal threaded portions in different diameters to cooperate with second external threaded portions in different diameters according to various requirements.

In actual assembling, the screwed portion 20 is screwed from outside to the assembling hole 12, and the fixing portion 30 is disposed through the drum rim 52 and screwed to the screwed portion 20 until the abutting head 31 abuts against the drum rim 52. During the assembling process, there is no need to disassemble the main body 10 from the drum body 51. Hence, it is convenient to assemble the drum frame fixer 1.

Figure 5:
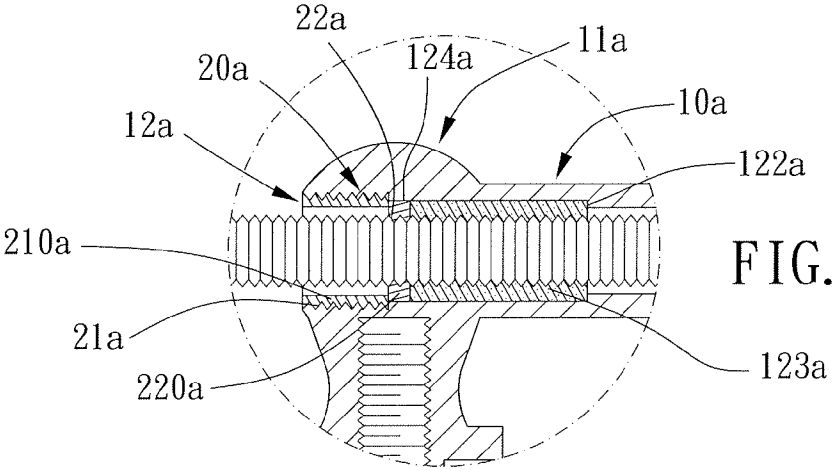
FIG. 5 is a partial cross-sectional drawing of the second embodiment of the present invention.
Figure 4:
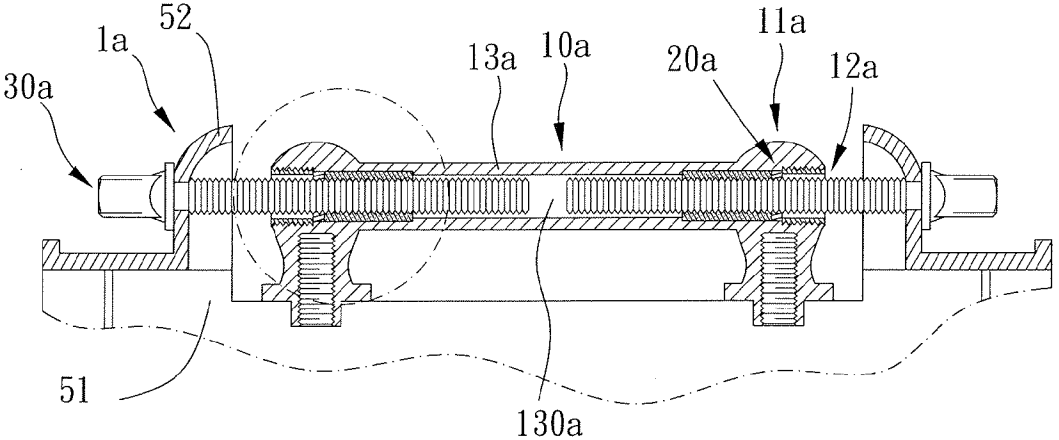
FIG. 4 is a cross-sectional drawing of a second embodiment of the present invention.

Please refer to FIGS. 4 and 5 for a second embodiment of a drum frame fixer 1*a*. Compared with the embodiment as shown in FIGS. 1 to 3, the screwed portion of this embodiment is not limited to a one-piece member. A screwed portion 20*a* of the drum frame fixer 1*a* includes a first sleeve body 210*a* and a second sleeve body 220*a*, the first sleeve body 210*a* has a first external threaded portion 21*a*, the second sleeve body has a second internal threaded portion 22*a*, and the second sleeve body 220*a* is positionably disposed between an assembling hole 12*a* and the first sleeve body 210*a* so that the second sleeve body 220*a* does not disengage from the assembling hole 12*a*.

The assembling hole 12*a* of the second embodiment may also be formed with an internal shoulder portion 122*a*, and an intermediate member 123*a* is inserted into the assembling hole 12*a*. The intermediate member 123*a* abuts against between the second sleeve body 220*a* and the internal shoulder portion 122*a* axially, the fixing portion 30*a* is inserted into the intermediate member 123*a* (in other embodiments, the intermediate member may abut against between the fixing portion and the second sleeve body radially to allow the second sleeve body and the internal shoulder portion abut against each other axially); therefore, the intermediate member 123*a* can be positioned restrictedly and provide shock-absorbing and anti-loosening effect.

In order to fix the second sleeve body 220*a* when the sleeve body 220*a* is for the fixing portion 30*a* to be screwed thereto, each said assembling hole 12*a* is further formed with a recess 124*a* corresponding to the second sleeve body 220*a*. The second sleeve body 220*a* is a non-round sleeve, and the second sleeve body 220*a* unrotatably abuts against a wall surface of the recess 124*a*. Specifically, the first sleeve body 210*a* is screwed from an end side of the main body 10*a* inwardly into the assembling hole 12*a* so as to restrictedly position the second sleeve body 220*a*.

The drum frame fixer 1, la as shown in the first and second embodiments in FIGS. 1 to 5 and 5*a* includes two said screwed portions 20, 20*a* and two said fixing portions 30, 30*a* for fastening two said drum rims 52 to the drum body 51 opposite to each other. The main body 10, 10*a* further includes two fastening portions 11, 11*a* and a body portion 13, 13*a* disposed between the two fastening portions 11, 11*a*, and each said fastening portion 11, 11*a* is formed with one said assembling hole 12, 12*a*. The main body 10, 10*a* is provided for being arranged between the two drum rims 52 so that the two assembling holes 12, 12*a* face the two drum rims 52 respectively, each said fastening portion 11, 11*a* is for being fastening on the drum body 51, and each said fixing portion 30, 30*a* is assembled to one said drum rim 52 and one said screwed portion 20, 20*a*.

Figure 6:
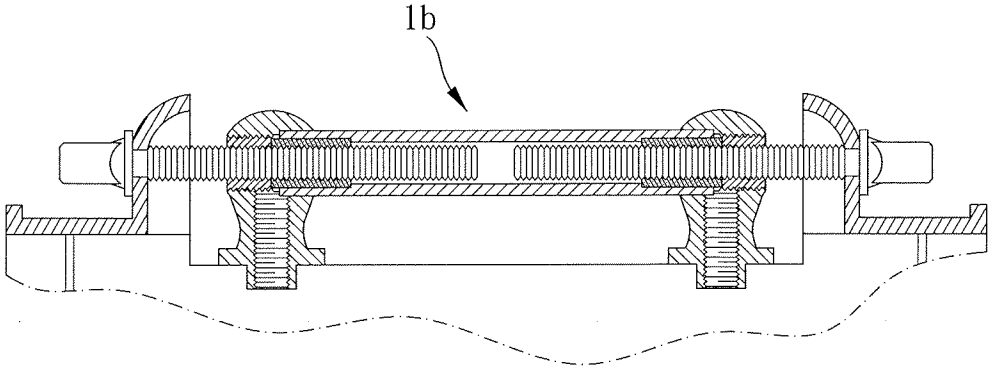
FIG. 6 is a cross-sectional drawing of a third embodiment of the present invention.

In the first and second embodiments, the two fastening portions 11, 11*a* and the body portion 13, 13*a* are integrally formed as a one-piece member so that each said screwed portion 30, 30*a* can only be screwed from two end sides of each said main body 10, 10*a* toward an inner portion of each said main body 10, 10*a* (a fastening portion and a body portion of a drum frame fixer 1*b* as shown in FIG. 6 are disengageable). In addition, the main body 10, 10*a* is made of zinc-aluminum alloy which is advantageous to processing, and the main body 10, 10*a* can have a shiny surface.

Furthermore, the body portion 13, 13*a* further includes a through hole 130, 130*a*. Each said assembling hole 12, 12*a* penetrates through one said fastening portion 11, 11*a* and communicates with the through hole 130, 130*a*, and a part of each said intermediate member 123, 123*a* is disposed in the body portion 13, 13*a*, and the other part of each said intermediate member 123, 123*a* is disposed in the fastening portion 11, 11*a*. In other embodiments, a number of the intermediate member in the main body is not limited to two. There may be only an intermediate member being disposed in a center of the body portion, and each of two ends of the intermediate member is inserted by a fixing portion to provide shock-absorbing and anti-loosening effect.

Given the above, the drum frame fixer is screwed to the fastening portion via threads on an outer side of the screwed portion so as to screw the screwed portion into the assembling hole. In addition, the screwed portion may be screwed to the assembling hole from an outer side of main body; therefore, when a user wants to replace the screwed portion, s/he does not need to disassemble the main body from the drum body.

While we have shown and described various embodiments in accordance with the present invention, it should be clear to those skilled in the art that further embodiments may be made without departing from the scope of the present invention.

What is claimed is:

1. A drum frame fixer, provided for fastening at least one drum rim on a drum body, including:

a main body, provided for being arranged on a circumferential face of the drum body, formed with at least one assembling hole, an inner wall of each said assembling hole being formed with a first internal threaded portion;

at least one screwed portion, each said screwed portion having a first external threaded portion and a second internal threaded portion, each said first external threaded portion screwed in each said first internal threaded portion; and at least one fixing portion, each said fixing portion having an abutting head and a second external threaded portion, each said fixing portion provided for being disposed through the drum rim, the abutting head abutting against a side of the drum rim, the second external threaded portion being screwed to the second internal threaded portion of the screwed portion located by the other side of the drum rim.

2. The drum frame fixer of claim 1, wherein each screwed portion is a one-piece member which is integrally formed, and the second internal threaded portion is provided on an inner wall surface of the screwed portion.

3. The drum frame fixer of claim 2, wherein the assembling hole is further formed with an internal shoulder portion, an intermediate member is inserted into the assembling hole, the intermediate member abuts against between the screwed portion and the internal shoulder portion axially, the fixing portion is inserted into the intermediate member, and the screwed portion is screwed from an end side of the main body inwardly into the assembling hole.

4. The drum frame fixer of claim 1, wherein the screwed portion includes a first sleeve body and a second sleeve body, the first sleeve body has the first external threaded portion, the second sleeve body has the second internal threaded portion, and the second sleeve body is positionably disposed between the assembling hole and the first sleeve body.

5. The drum frame fixer of claim 4, wherein the assembling hole is further formed with an internal shoulder portion, an intermediate member is inserted into the assembling hole, the intermediate member abuts against between the second sleeve body and the internal shoulder portion axially, and the fixing portion is inserted into the intermediate member.

6. The drum frame fixer of claim 5, wherein each said assembling hole is further formed with a recess which is corresponding to the second sleeve body, the second sleeve body is a non-round sleeve, the second sleeve body non-rotatably abuts against a wall surface of the recess, and the first sleeve body is screwed from an end side of the main body inwardly into the assembling hole.

7. The drum frame fixer of claim 1, wherein the drum frame fixer includes two said screwed portions and two said fixing portions for fastening two said drum rims on the drum body, the main body further includes two fastening portions and a body portion disposed between the two fastening portions, each said fastening portion is formed with one said assembling hole, the main body is for being disposed between the two drum rims so that the two assembling holes face the two drum rims respectively, each said fastening portion is for being fastened on the drum body, and each said fixing portion is assembled to one said drum rim and one said screwed portion.

8. The drum frame fixer of claim 7, wherein the two fastening portions and the body portion are integrally formed as a one-piece member.

9. The drum frame fixer of claim 7, wherein the main body is made of zinc-aluminum alloy.

10. The drum frame fixer of claim 7, wherein the body portion further includes a through hole, and each said assembling hole penetrates through one said fastening portion and communicates with the through hole.

* * * * *